United States Patent [19]

Williams

[11] Patent Number: 4,545,150

[45] Date of Patent: Oct. 8, 1985

[54] COMBINED GATE AND LOCK ASSEMBLY

[76] Inventor: Richard B. Williams, Apt. 11B, Mohawk Village Apts., Amsterdam, N.Y. 12010

[21] Appl. No.: 609,713

[22] Filed: Nov. 20, 1984

[51] Int. Cl.[4] ..... E05C 7/04

[52] U.S. Cl. ..... 49/366; 49/394; 292/148; 292/150; 292/259 R; 70/417

[58] Field of Search ..... 49/366, 394, 56, 67; 292/258, 148, 259, 288; 70/238, 181, DIG. 65, 417

[56] References Cited

U.S. PATENT DOCUMENTS

| | | | |
|---|---|---|---|
| 1,176,407 | 3/1916 | Shirey | 292/259 |
| 1,540,490 | 6/1925 | Mertel | 49/381 |
| 1,812,866 | 7/1931 | Drouin | 49/381 |
| 2,856,220 | 10/1958 | Easley | 292/148 |
| 3,656,788 | 4/1972 | Emery | 292/259 |
| 4,019,281 | 4/1977 | Weiler | 49/56 |
| 4,491,354 | 1/1985 | Williams | 292/148 |

*Primary Examiner*—Kenneth Downey

*Attorney, Agent, or Firm*—Walter F. Wessendorf, Jr.

[57] ABSTRACT

Disclosed is a combined gate and lock assembly of tubular construction comprising two horizontal female members fixed to two vertical posts pivotally mounted with respect to support structure. In the closed position, the longitudinal axes of the female members are aligned and receive coaxially in recipro cable relationship therein a male member having an eye engaged by the shackle of a padlock. In the open position, the male member is appropriately disengaged from one of the female members which are disposed in their open position by appropriate rotation of their vertical posts.

2 Claims, 2 Drawing Figures

41
37
13
33
29
9
21
25
5
17
47
51
53
49
43
45

3
11
35
39
31
27
7
19
23
15
I
43
45
3

COMBINED GATE AND LOCK ASSEMBLY

BACKGROUND OF THE INVENTION

1. Technical Field

This invention relates to a combined gate and lock assembly to provide security against intruders.

2. Background

The problem in the art to which this invention apertains is the need for a combined gate and lock assembly to provide security against intruders, and which is of simple construction, is easy to assemble and is easy to install.

Accordingly, the object of the invention is to contribute to the solution of the discussed problem of the art by providing a combined gate and lock assembly of steel or other suitable material comprising two horizontal female members fixed to two vertical posts that are in pivotal relationship with support structure. The two horizontal female members receive therein in reciprocable relationship a male member. Cross pins in each of the two horizontal female members function as limit stops to limit the extent to which the male member can be reciprocated within such horizontal female members. The gate is operatively disposed in its open position by reciprocating such male member sufficiently in one direction in one of the two horizontal female members to disengage and clear such male member from its operative engagement with the other one of the two horizontal female members, following which the two horizontal female members can be rotated and disposed in their open positions by appropriate and corresponding rotation sufficiently of their respective vertical posts.

The gate is operatively disposed in its closed position by appropriate and corresponding rotation of the vertical posts to thereby dispose their respective horizontal female members in alignment with each other, following which the male member is appropriately reciprocated sufficiently in one direction to again operatively engage sufficiently such other one of the two female members. A padlock is appropriately disposed such that its shackle is lockingly engaged with an eye in the middle of such male member to prevent either end of such male member from being reciprocated sufficiently to disengage and clear such male member end from its engagement with such corresponding horizontal female member.

SUMMARY OF THE INVENTION

In accordance with the invention, there is provided a combined gate and lock assembly comprising two horizontal female members fixed to two vertical posts via tees and angled support struts. The distal ends of the vertical posts freely pivot within sleeve support structures fixed or otherwise imbedded in the ground. The proximal ends of the vertical posts are fixed to the tees. Upstanding from the tees are pintles which freely pivot within elbows of horizontal support structures. The combined gate and lock assembly has a closed or locked position and an open position.

In such closed or locked position, the horizontal female members are in axially aligned relationship and receive in reciprocable relationship therein a male member whose movement is limited by cross pins in the female members functioning as limit stops. The shackle of a padlock lockingly engaged with an eye in the middle of the male member prevents either end of such male member from being reciprocable sufficiently to disengage and clear such male member end from operative engagement with its corresponding horizontal female member.

In such open position, such padlock shackle is removed from the eye of such male member. Next, such male member is reciprocated sufficiently in one direction in one of the two horizontal female members to disengage and clear such male member from its operative engagement with the other one of the two horizontal female members. Thereupon, the two horizontal female members can be rotated and disposed in their open positions by appropriate and corresponding rotation sufficiently of their respective vertical posts.

BRIEF DESCRIPTION OF THE DRAWINGS

This object and other objects of the invention should be discerned and appreciated by reference to the perspective view of the combined gate and lock assembly.

DESCRIPTION OF THE PREFERRED EMBODIMENT

Figures 1, 1A:
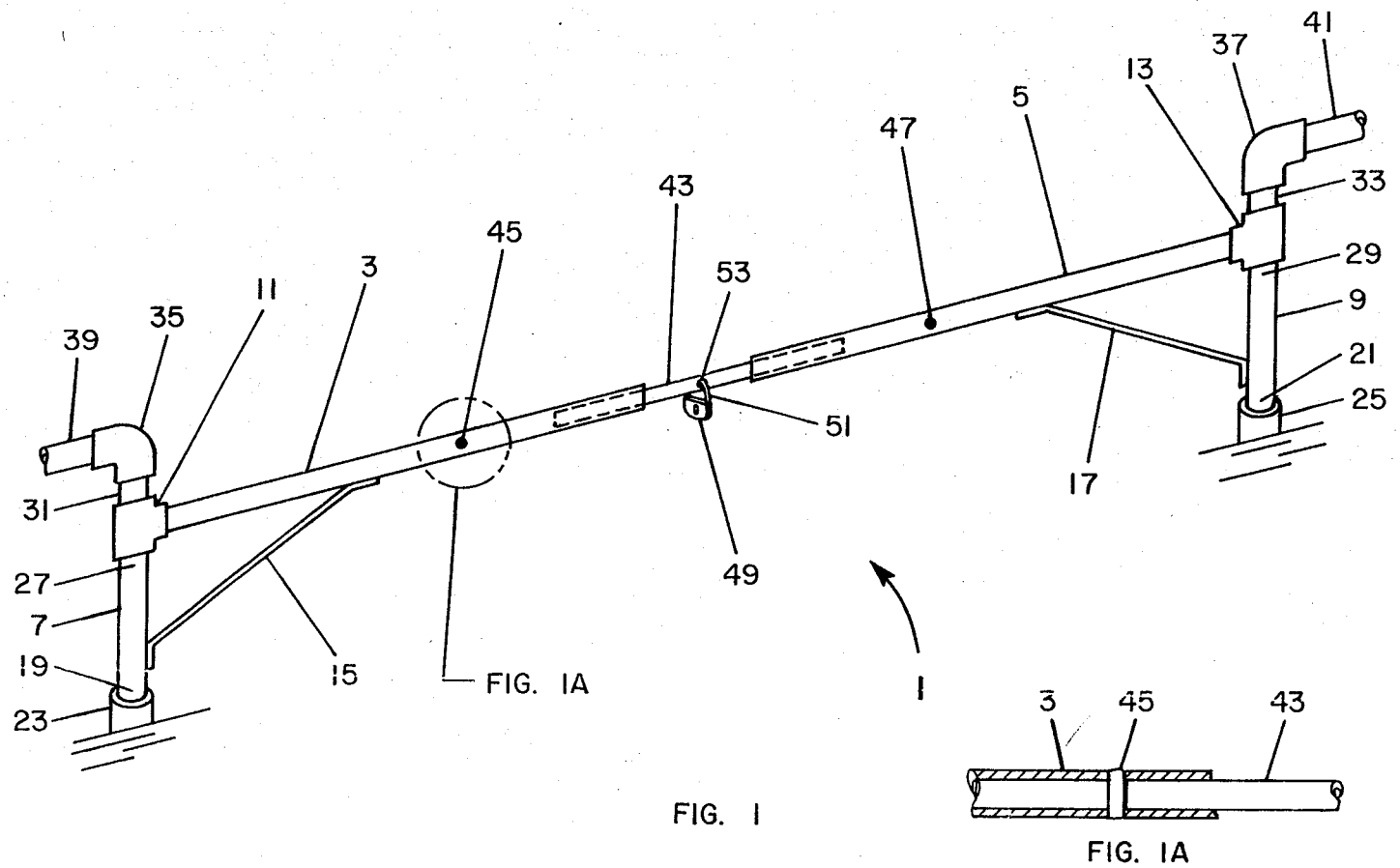

In the drawing, reference numeral 1 generally refers to the combined gate and lock assembly comprising two horizontal female members 3 and 5 fixed to two respective vertical posts 7 and 9 via tees 11 and 13 and angled support struts 15 and 17. The distal ends 19 and 21 of the vertical posts 7 and 9 freely pivot within support structures defined by sleeves 23 and 25 fixed or otherwise imbedded in the ground. The proximal ends 27 and 29 of the vertical posts 7 and 9 are fixed to the tees 11 and 13. Upstanding from the tees 11 and 13 are pintles 31 and 33 which freely pivot within the openings of elbows 35 and 37 fixed to horizontal support structures 39 and 41.

The horizontal female members 3 and 5 freely receive therein in reciprocable relationship a male member 43. Cross pins 45 and 47 in the female members 3 and 5 function as limit stops to limit the extent to which male member 43 can be reciprocated within such female members 3 and 5. A padlock 49 with its shackle 51 engaged with an eye 53 in the middle of male member 43 prevents either end of male member 49 from being reciprocated sufficiently coaxially relative to the aligned longitudinal axes of female members 3 and 5 to disengage and clear an end of male member 43 from its operative engagement with the corresponding one of the female members.

The combined gate and lock assembly 1 has a closed or locked position and an open position, the operations of which have been hereinbefore described under the headings BACKGROUND OF THE INVENTION and SUMMARY OF THE INVENTION.

Having thusly described my invention, I claim:

1. A combined gate and lock assembly comprising sleeves, vertical posts, tees, two horizontal female members, pintles, support structure, a male member and cross pins; said sleeves, vertical posts, pintles, support structure and male member being of tubular construction, said sleeves being fixed to or otherwise imbedded in the ground, said vertical posts having distal ends and proximal ends, said sleeves receiving said distal ends of said vertical posts in pivotal mounting relationship, said tees being fixed to said proximal ends of said vertical posts and to said horizontal female members, said pintles being vertically upstanding from said tees and in fixed relationship therewith, said support structure having openings, said openings of said support structure freely receiving said pintles in pivotal mounting relationship therewith, said female members freely receiving therein said male member in reciprocable relationship; said combined gate and lock assembly having a closed position and an open position: in said closed position, said horizontal female members being axially aligned and coaxially receiving therein said male member, and in said open position, said male member being disengaged and cleared from operative engagement with one of said female members; said female members carrying said cross pins, said cross pins functioning as limit stops to limit the extent to which said male member can be reciprocated within said female members.

2. A combined gate and lock assembly in accordance with claim 1, wherein is further provided a padlock having a shackle, wherein said male member has an eye, wherein said padlock shackle is lockingly engaged with said eye of said male member to prevent, in the closed position of said combined gate and lock assembly, said male member from being reciprocated sufficiently to disengage and clear said male member from its operative engagement with either one of said female members.

* * * * *